US007002085B2

(12) United States Patent
Ullmann et al.

(10) Patent No.: US 7,002,085 B2
(45) Date of Patent: Feb. 21, 2006

(54) SLIDE SWITCH

(75) Inventors: Roland Ullmann, Offenbach (DE); Thorsten Pohl, Muhlheim (DE)

(73) Assignee: Braun GmbH, Kronberg (DE)

( * ) Notice: Subject to any disclaimer, the term of this patent is extended or adjusted under 35 U.S.C. 154(b) by 96 days.

(21) Appl. No.: 10/794,529

(22) Filed: Mar. 5, 2004

(65) Prior Publication Data

US 2004/0188229 A1 Sep. 30, 2004

(30) Foreign Application Priority Data

Mar. 8, 2003 (DE) ..... 103 10 163

(51) Int. Cl.
*H01H 9/00* (2006.01)

(52) U.S. Cl. ..... 200/5 R; 200/541; 200/252; 200/321

(58) Field of Classification Search ..... 200/541, 200/547, 252, 318.2, 321, 43.11, 43.13, 43.16, 200/571
See application file for complete search history.

(56) References Cited

U.S. PATENT DOCUMENTS

| | | | | |
|---|---|---|---|---|
| 4,454,391 | A * | 6/1984 | Olsson | 200/16 D |
| 4,504,707 | A * | 3/1985 | Ochiai | 200/43.17 |
| 4,882,458 | A | 11/1989 | Berg et al. | |
| 4,886,946 | A * | 12/1989 | Franks, Jr. | 200/329 |
| 4,920,244 | A * | 4/1990 | Gundlach | 200/321 |

FOREIGN PATENT DOCUMENTS

| | | |
|---|---|---|
| DE | 25 17 922 | 11/1975 |
| DE | 40 15 695 | 11/1991 |
| EP | 0307601 | 3/1989 |

* cited by examiner

*Primary Examiner*—Richard K. Lee
(74) *Attorney, Agent, or Firm*—Fish & Richardson P.C.

(57) ABSTRACT

A slide switch, in particular for an electric small appliance, with a switch slide slidably mounted in a housing and a locking switch that is arranged in the switch slide and is adapted to be locked with the housing or with a member connected with the housing in at least one switching position of the switch slide. The locking switch is comprised of at least one resiliently biased pushbutton pivotal about a pivot axle, the pivot axle being arranged in a fixed relationship to the switch slide.

21 Claims, 3 Drawing Sheets

SLIDE SWITCH

CROSS REFERENCE TO RELATED APPLICATION

This application claims priority to German Patent Application No. DE 103 10 163.2, filed Mar. 8, 2003, which is incorporated herein by reference in its entirety.

TECHNICAL FIELD

This invention relates to slide switches, and more particularly to slide switches for small electric appliances.

BACKGROUND

Slide switches can be used to prevent inadvertent activation of electric appliances and are characterized in that the locking function, meaning the locking mechanism, is integrated with the slide switch itself. Slide switches with a locking button whose direction of actuation is perpendicular to the sliding direction of the slide switch require, on account of this linear motion, a comparatively long switching travel for unlocking. This causes the locking button to be offset a distinct amount inward or outward relative to the slide switch or the housing outer contour. Therefore, it is desirable to provide a slide switch, which in spite of the integrated locking switch, is adaptable to the contour of the associated appliance. In particular, it is desirable that unlocking of the slide switch be accomplished by an extremely low expenditure of energy and motion, so that the locking switch is integrated with the slide switch in flush-fitted manner regardless of its switching position. At the same time, it is desirable for the entire slide switch to be of straightforward construction requiring little assembly effort.

SUMMARY

In one aspect of the present invention, a locking switch is comprised of at least one resiliently biased pushbutton pivotal about a pivot axle, the pivot axle being arranged in a fixed relationship to the switch slide. In order to minimize possible switching travel of the locking switch, one feature of the invention is to arrange at least one latch in the end region of the pushbutton facing away from the pivot axle or even have it protrude in the direction facing away from the associated pivot axle. This enables maximum use to be made of the lever effect of the pivotal pushbutton.

Arranging for the pivot axle of the pushbutton to extend parallel to the displacement path of the switch slide enables the locking mechanism to be implemented with particular ease. In particular, the locking switch can then be formed by two adjoining, pivotal pushbuttons whose pivot axles lie in the pushbutton regions facing away from each other. In this arrangement, the adjoining sides of the pushbuttons have inter-fitting engagement with each other so that, through this coupling engagement, no protruding edges are formed in the transition region between the two pushbuttons. In addition, the interior space is protected from contamination without requiring additional sealants. The resilient bias of the pushbutton is preferably in the direction of a locked position of the slide switch.

Aspects of the present invention combine a reliable switching function with very high user comfort and an extremely low overall height so that the basic dimensions of the associated appliance are increased only minimally. To reach an unlocked position, it is only necessary for the user to touch the locking switch with a light hand, in particular with a thumb. Thus, the user is not required to perform a conscious, active unlocking function, but rather merely has to grasp the slide switch at the proper location and slide it. Owing to the low overall height, the locking switch can be ideally integrated with the slide switch and can be shaped to conform to its outer contour. This practically obviates the possibility of accidental actuation, in contrast to a locking switch that protrudes from the slide switch and may easily catch somewhere during handling of the appliance.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
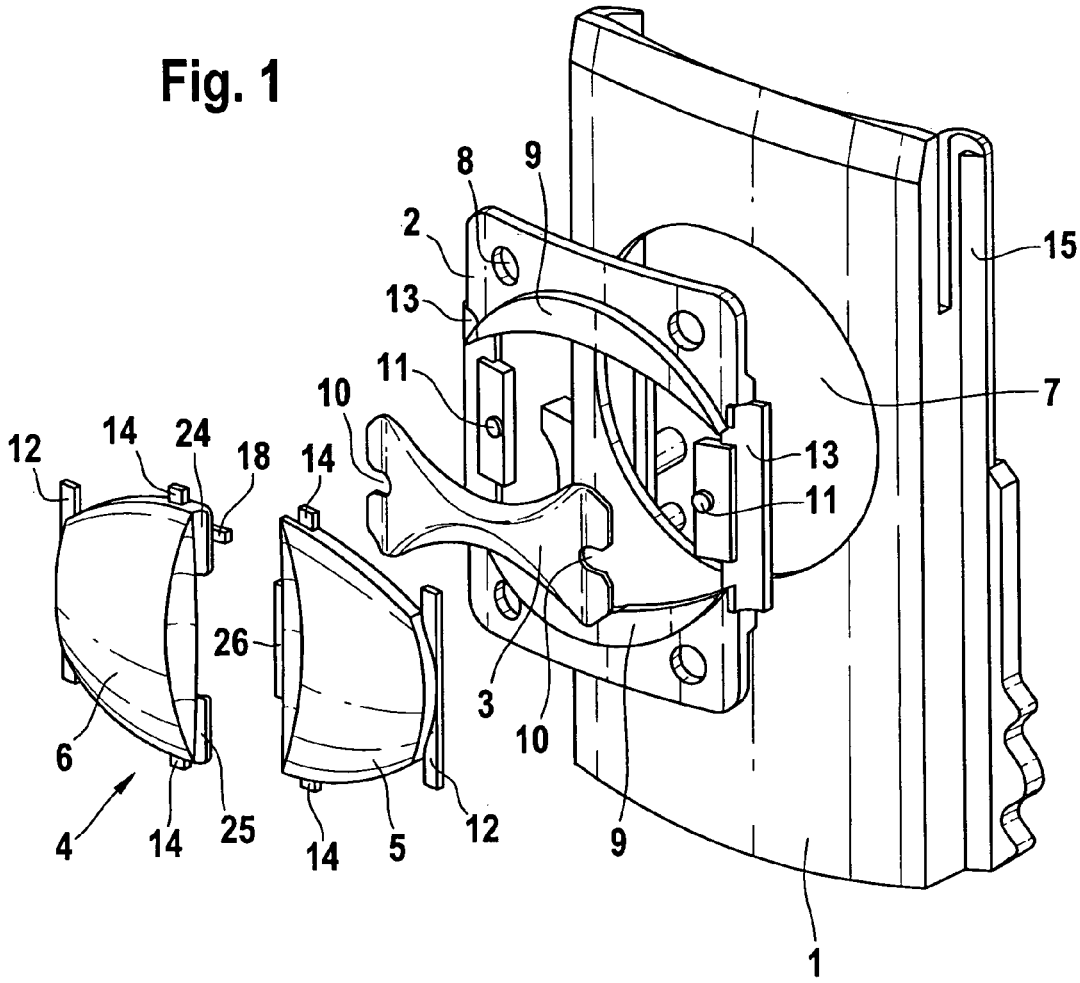
FIG. 1 is an exploded view of the slide switch of the present invention.

In the exploded view of FIG. 1, the slide switch includes a switch slide 1 mounted for displacement along its longitudinal axis on an electrical appliance (not shown for the sake of clarity of the illustration) and a mounting frame 2 for fastening a leaf spring 3 and associated locking switch 4. In this embodiment, the locking switch 4 is comprised of two pushbutton halves 5, 6. The locking switch 4 is installed from a rear side of the switch slide 1 in such manner that the two pushbutton halves 5, 6 come to lie within the circular cutout 7 provided in the front side of the switch slide 1.

The mounting frame 2 is provided with four eyelets 8 arranged in corner regions for attachment to the switch slide 1 by means of a riveting or hot caulking operation. Crescent-shaped projections 9 of the mounting frame 2 have their circular outer contour in abutting engagement with the boundary of the cutout 7, thus locating the mounting frame 2 centrally in the switch slide 1. In the area of its left and right hand ends, the leaf spring 3 is provided with a notch 10 which, with the spring in assembled condition, is engaged by fixing knobs 11 disposed on the mounting frame 2. Formed on each of the end portions of the pushbutton halves 5, 6, at the ends facing away from each other, are pivot axles 12. In assembled condition, pivot axles 12 are held and guided by bearing faces 13 of the mounting frame 2 and by the inner side of the switch slide 1. These pivot axles 12 are aligned along the longitudinal axis, that is, the direction of displacement of the switch slide 1. Upwardly and downwardly extending stops 14 are formed in the area of the pushbutton halves 5, 6 remote from the pivot axle 12. Stops 14 engage behind the mounting frame 2 to secure the pushbutton halves 5, 6 against swinging out of the cutout 7. Owing to the resilient bias produced by the leaf spring 3, the stops are urged against the mounting frame 2. The arrangement of the stops 14 is selected so that the pushbutton halves 5, 6 are aligned flush with the crescent-shaped projections 9. Those skilled in the art will recognize that mechanisms other than the pivot axles described above can be used to define and implement pivot axes about which the pushbuttons pivot.

Figure 2:
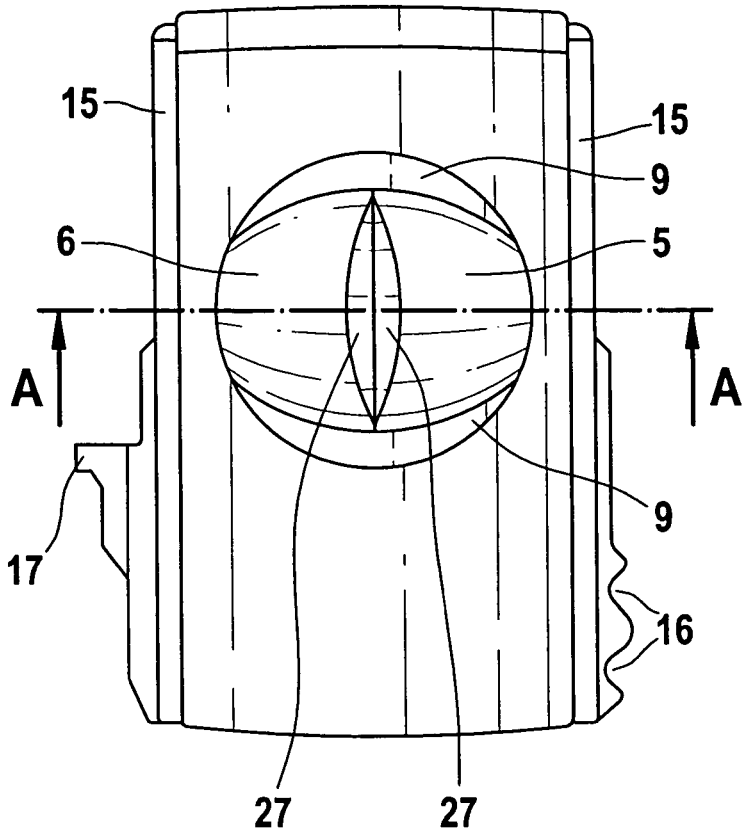
FIG. 2 is a top plan view of the slide switch shown in FIG. 1.

As shown in FIG. 2, the switch slide 1 includes lateral rail-shaped guide profiles 15 for mounting the slide switch 1 in the associated electrical appliance. In addition, the slide switch also includes detent noses 16 to be acted upon by a detent spring (not shown) and one or several actuating arms 17 for actuating one or several electric switches. However, it is also possible to arrange switch contacts, for example in the form of electrically conductive tracks, directly on the switch slide 1.

At least one of the pushbutton halves 5, 6 includes at its end remote from the respective pivot axle 12 at least one latch 18 extending a suitable amount inward, that is, in the direction of the associated electrical appliance.

Figure 3:
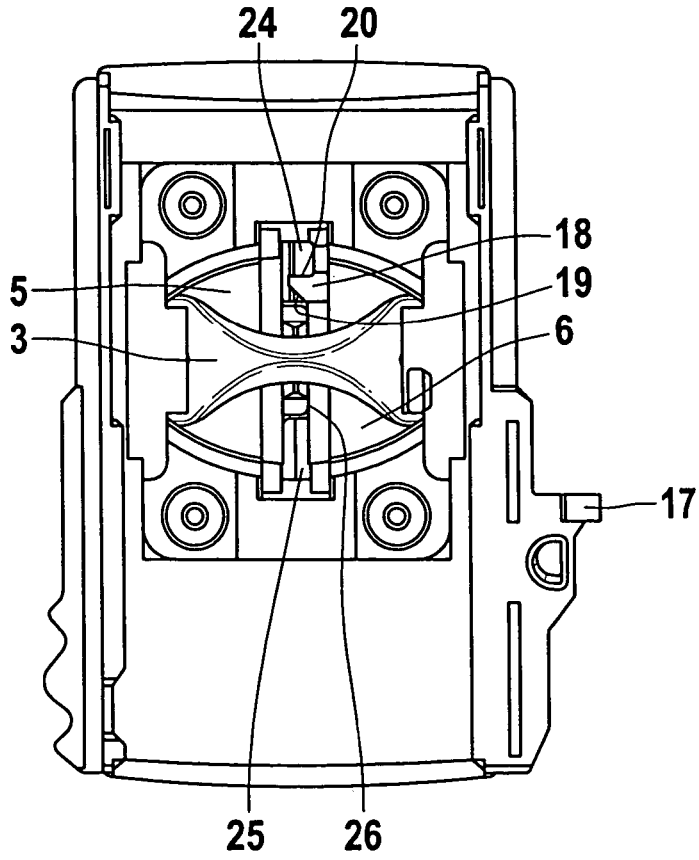
FIG. 3 is a rear view of the slide switch shown in FIG. 1.

In this embodiment, the latch 18 is disposed on the pushbutton half 6 and—see in particular FIG. 3—is provided with an incline 19. This incline is at an angle of about 45° relative to the longitudinal axis or the direction of displacement of the switch slide 1. This incline 19 is arranged opposite the locking stop 20 formed as a straight surface and extending in a direction transverse to the displacement direction. The alignment of the locking stop 20 ensures a reliable locking of the switch slide 1 which can be canceled only by actuation of the locking switch 4, while the incline 19 enables the switch slide 1 to be shifted back into the locked condition without actuation of the locking switch.

Figure 4:
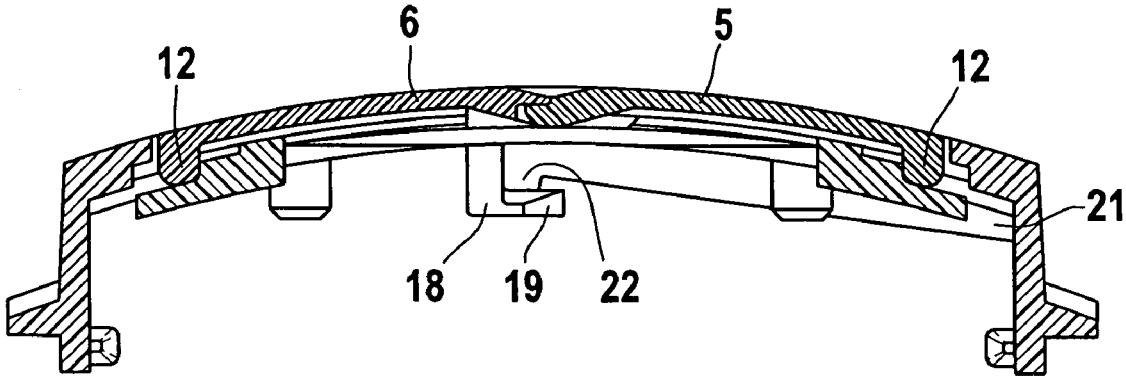
FIGS. 4 and 5 are sectional views taken along the line A—A of FIG. 2, showing the locking switch in the locked and unlocked positions, respectively.
Figure 5:
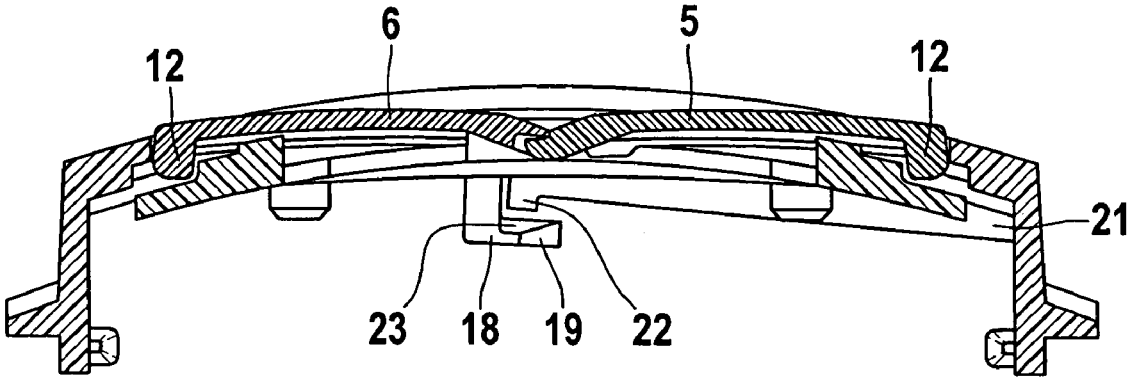

FIGS. 4 and 5 each show a section taken along the line A—A of FIG. 2, that is, in the direction in which the slide switch is moved from its locked position. These Figures thus present a view directly at the incline 19 of the latch 18 formed on the pushbutton half 6. They also show the latch stop 22 disposed on the housing 21 and cooperating with the latch 18. In the non-activated condition of the locking switch 4, the locking stop 20 abuts the latch stop 22, thereby preventing an upward displacement of the switch slide 1 out of the locked position. This position is illustrated in FIG. 4. By actuating the locking switch 4 with a light touch, the two pushbutton halves 5, 6 swing about their respective pivot axles 12, so that the latch 18, which is caused to follow this swinging motion, releases the latch stop 22, allowing a displacement of the switch slide. Owing to the incline 19 and the ramp 23 disposed on the outward facing side of the latch 18, that is, the side facing away from the electrical appliance, the switch slide 1 can be shifted back into the locked position also without actuation of the locking switch 4. As this occurs, the locking switch is switched automatically solely on account of the shift back movement by the incline 19 and the ramp 23.

In order to make sure that the unlocking function is performed regardless of whether the pushbutton half 5 or the pushbutton half 6 or both pushbutton halves are actuated, the two pushbutton halves are arranged in an inter-fitting engagement with each other. To this effect, the pushbutton halves 5 and 6 are provided with engaging portions 24, 25 and 26 on the sides facing each other, that is, opposite the pivot axles. The engaging portions 24 and 25 are formed integrally with the upper and lower regions, respectively, of the pushbutton half 6, leaving a mid-section free. This midsection is engaged by the engaging portion 26 which is integrally formed with the pushbutton half 5. Each of the engaging portions 24 to 26 engages behind the opposite pushbutton half 5 and 6 so that actuation of the one pushbutton half automatically causes the other pushbutton half to be actuated as well.

The facing regions of the pushbutton halves 5 and 6 have spherically domed recesses 27 on their outwardly directed surface. These spherically domed recesses 27 induce the user to apply a digit, in particular a thumb when a handheld appliance is involved, to this particular spot for unlocking the slide switch.

A number of embodiments of the invention have been described. Nevertheless, it will be understood that various modifications may be made without departing from the spirit and scope of the invention. For example, the pushbuttons can be resiliently biased toward a locked position. Accordingly, other embodiments are within the scope of the following claims.

What is claimed is:

1. A slide switch, comprising:

a housing;

a switch slide slidably mounted in the housing; and a locking switch arranged in the switch slide and lockable with the housing in at least one switching position of the switch slide, the locking switch comprising at least one resiliently biased pushbutton pivotal about a pivot axis arranged in a fixed relationship to the switch slide.

2. The slide switch of claim 1, wherein the pushbutton is resiliently biased toward a locked position.

3. The slide switch of claim 1, further comprising at least one latch arranged in the end region of the pushbutton and facing away from the pivot axis.

4. The slide switch of claim 3, wherein the pivot axis of the pushbutton extends parallel to a displacement path of the switch slide.

5. The slide switch of claim 4, comprising two adjoining, pivotal pushbuttons with pivot axes lying in regions of the pushbuttons facing away from each other.

6. The slide switch of claim 5, wherein adjoining sides of the adjoining pushbuttons have inter-fitting engagement with each other.

7. The slide switch of claim 6, wherein the pushbuttons are each resiliently biased toward a locked position.

8. The slide switch of claim 5, wherein adjacent edges of the two adjoining pushbuttons remain overlapped during switch activation.

9. The slide switch of claim 5, further comprising a leaf spring underlying the two pushbuttons and spanning adjoining edges of the pushbuttons.

10. The slide switch of claim 1, wherein the pivot axis is defined by a pivot axle extending from the pushbutton.

11. The slide switch of claim 10, wherein the pivot axle comprises a pair of projections extending from opposite sides of the pushbutton.

12. A slide switch, comprising:

a housing;

a switch slide secured to the housing for sliding motion along a displacement path;

a locking switch arranged in the switch slide and lockable with the housing in at least one switching position of the switch slide, the locking switch comprising two adjoining, resiliently biased pushbuttons pivotal about respective pivot axes in regions of the pushbuttons facing away from each other, wherein the pivot axes are arranged in a fixed relationship to the switch slide and parallel to the displacement path of the switch slide; and at least one latch arranged in an end region of one of the pushbuttons adjoining the other pushbutton.

13. The slide switch of claim 12, wherein the pushbuttons are each resiliently biased toward a locked position.

14. The slide switch of claim 13, wherein adjoining sides of the adjoining pushbuttons have inter-fitting engagement with each other.

15. The slide switch of claim 12, wherein adjacent edges of the two adjoining pushbuttons remain overlapped during switch activation.

16. The slide switch of claim 12, further comprising a leaf spring underlying the two pushbuttons and spanning adjoining edges of the pushbuttons.

17. The slide switch of claim 12, wherein the pivot axes of the pushbuttons are defined by respective pivot axles extending from the pushbuttons.

18. The slide switch of claim 17, wherein each pivot axle comprises a pair of projections extending from opposite sides of its respective pushbutton.

19. The slide switch of claim 12, wherein adjoining edges of the pushbuttons meet along a line parallel to the displacement path of the switch slide.

20. The slide switch of claim 19, wherein outer surfaces of the pushbuttons together define a recess along said line.

21. The slide switch of claim 12, wherein the switch slide and locking switch have outer surfaces that form an integrated, smooth contour at the regions of the pushbuttons facing away from each other in a locking position.

* * * * *